US006018326A

United States Patent [19]

Rudisill

[11] Patent Number: 6,018,326

[45] Date of Patent: Jan. 25, 2000

[54] ANTENNAS WITH INTEGRATED WINDINGS

[75] Inventor: Charles A. Rudisill, Apex, N.C.

[73] Assignee: Ericsson Inc., Research Triangle Park, N.C.

[21] Appl. No.: 08/939,821

[22] Filed: Sep. 29, 1997

[51] Int. Cl.[7] ..... H01Q 1/36

[52] U.S. Cl. ..... 343/895; 343/702; 29/600

[58] Field of Search ..... 343/702, 895, 343/872, 873; 29/600

[56] References Cited

U.S. PATENT DOCUMENTS

| | | | |
|---|---|---|---|
| 4,323,900 | 4/1982 | Krall et al. | 343/700 MS |
| 4,376,941 | 3/1983 | Zenel | 343/895 |
| 4,853,660 | 8/1989 | Schloemann | 333/204 |
| 5,198,831 | 3/1993 | Burrell | 343/895 |
| 5,341,149 | 8/1994 | Valimaa et al. | 343/895 |
| 5,403,197 | 4/1995 | Ernst et al. | 439/165 |
| 5,635,945 | 6/1997 | McConnell et al. | 343/895 |
| 5,678,201 | 10/1997 | Thill | 343/895 |

FOREIGN PATENT DOCUMENTS

| | | |
|---|---|---|
| 0446656A1 | 9/1991 | European Pat. Off. . |
| 0889541A1 | 7/1999 | European Pat. Off. . |
| WO92/05602 | 4/1992 | WIPO . |
| WO96/06468 | 2/1996 | WIPO . |
| WO96/21955 | 7/1996 | WIPO . |
| WO97/11507 | 3/1997 | WIPO . |
| WO98/30038 | 7/1998 | WIPO . |

OTHER PUBLICATIONS

PCT International Search Report, International Application No. PCT/US98/20304.

*Primary Examiner*—Don Wong
*Assistant Examiner*—Tan Ho
*Attorney, Agent, or Firm*—Myers Bigel Sibley & Sajovec, P.A.

[57] ABSTRACT

Radiotelephone antennas include rigid antenna elements integral to the antenna substrate or housing. As such, the present invention configures the antenna without requiring a separate flex circuit winding to provide the conductive windings in the antenna. Methods for fabrication of the antenna are also described. Preferably, the antenna is formed in a two-shot molding process.

48 Claims, 12 Drawing Sheets

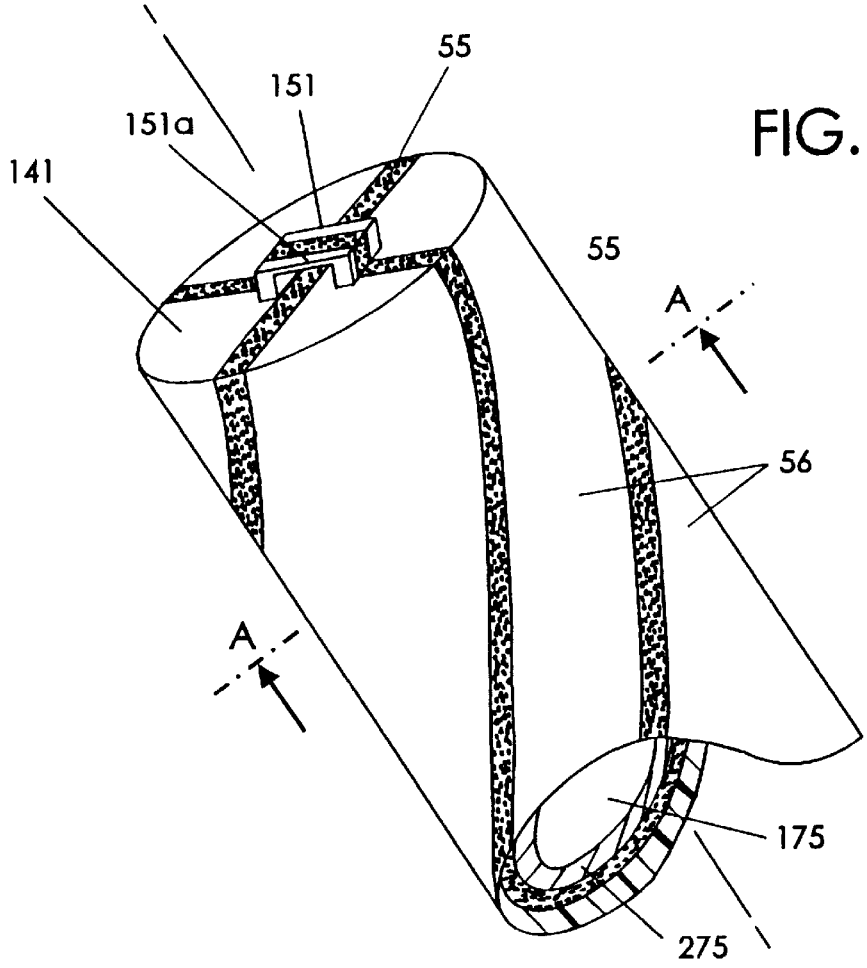
FIG. 6
FIG. 6A
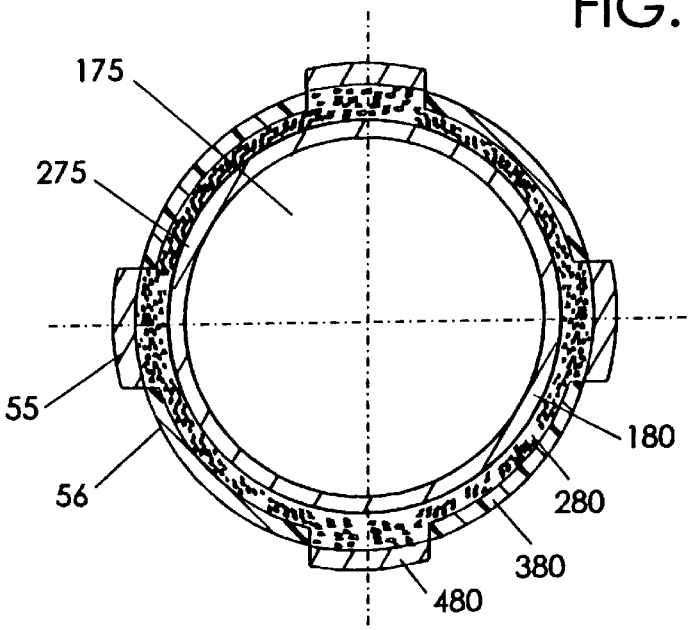

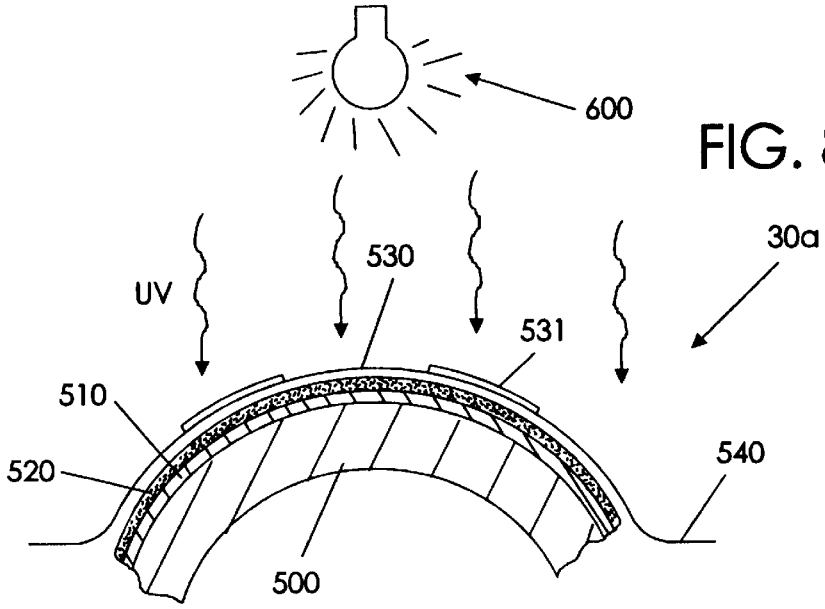
FIG. 8A
FIG. 8B
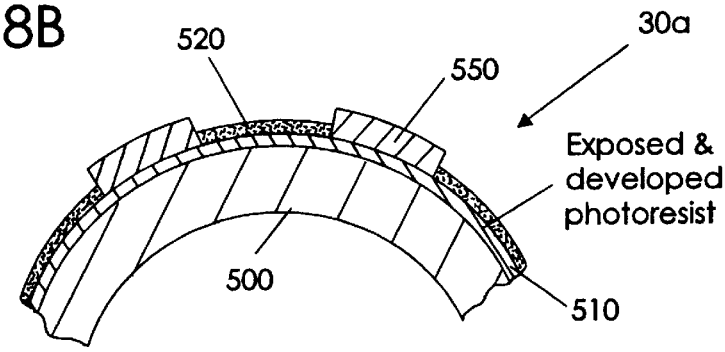
FIG. 8C
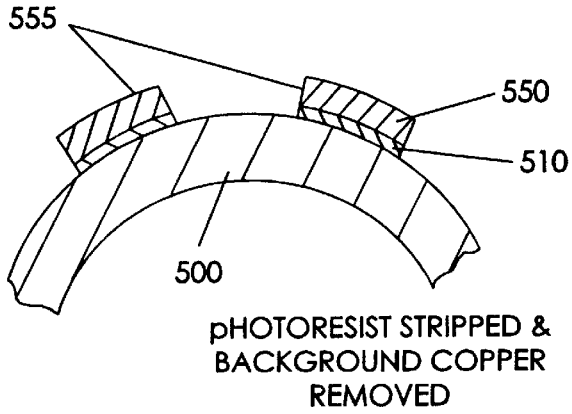

ANTENNAS WITH INTEGRATED WINDINGS

FIELD OF THE INVENTION

The present invention relates to telephones, and more particularly relates to antennas in telephones.

BACKGROUND OF THE INVENTION

Many telephones employ antennas which are electrically connected to a signal processor housed in the telephone. Various design parameters of the antenna can affect the performance of the radiotelephone. For example, the size and shape of the antenna as well as the way in which the electrical traces of the antenna are interconnected with associated circuitry can impact the performance of the radiotelephone. Additionally, many of the radiotelephones are undergoing miniaturization which can complicate and impose design restraints on the antenna. For example, this miniaturization can create complex mechanical and electrical connections with other components such as the outwardly extending antenna which must generally interconnect with the housing for mechanical support, and, to the signal processor and other internal circuitry operably associated with the printed circuit board in the radiotelephone body.

In the past, portable satellite radiotelephones have employed top loaded monopole antennas, helix antennas, and multiple winding antennas to help improve signal quality. One example of such an effort is a quadrafillar helix antenna which utilizes four spaced-apart filament elements which are wound around an antenna's surface. Preferably, the filament elements are equally spaced around the circumference of the antenna. Typically, these type of elements or windings are printed on a flat material such as a flex circuit material, cut into the appropriate pattern, and then rolled to form the antenna elements. Generally stated, the seams are then joined with adhesive or tape, and circuit components are attached to one end of the wrapped antenna elements to electrically interconnect the signal processing circuit in the radiotelephone. For example, as illustrated in FIG. 1, a polyimide film 15 with conductive elements 15*a* thereon is rolled to form a helix. Tape 16 is used to bond the seams. End caps 17*a*, 17*b* are positioned over opposing ends of the rolled film 18. A printed circuit board 19 and coaxial connectors 20 are positioned adjacent the lower end cap 17*b*. The connector's 20 associated wires 20*a* are routed into the radiotelephone (not shown) through the radome 21 which is positioned over the above-described components.

Unfortunately, fabrication of these flexible antenna elements are typically relatively fragile and can be labor intensive. Further, the positional tolerances of the elements relative to both the antenna cover or "radome" and the roll can be difficult to control. Positional and form variance and the seam construction of the flex windings can undesirably affect the performance of the antenna. Further, attaching the electrical components to the flex circuit material can stress the attachment joint(s) and can require strain-relief designs to attempt to protect the function, durability, and reliability of the antenna.

OBJECTS AND SUMMARY OF THE INVENTION

It is therefore a first object of the present invention to provide an improved method for fabricating an antenna with conductive windings.

It is another object of the present invention to provide an improved multi-winding antenna.

It is yet another object of the present invention to provide a reliable, durable, and economical satellite antenna for a radiotelephone.

It is a further object of the present invention to provide an improved antenna which can be conveniently adapted for use with existing radiotelephone models.

These and other objects are satisfied by the present invention which includes an antenna with integrated windings formed thereon. A first aspect of the invention is a radiotelephone antenna which comprises a longitudinally extending first member having at least one rigid conductive winding arranged in a first pattern thereon. The antenna also includes a longitudinally extending second member having at least one rigid conductive winding arranged in a second pattern thereon. The second member is configured to mate and engage with the first member to define an enclosed passage therebetween. When the first and second members are engaged, the first and second pattern of conductive windings are electrically connected and geometrically aligned in a pattern so as to define a signal path. Preferably, the first and second patterns radially translate along the length of the antenna in a helical pattern.

Advantageously, the antenna elements are formed directly onto the antenna housing. Thus, using integral rigid antenna elements can reduce assembly time and labor costs and can reduce manufacturing build variability and improve durability.

In a second embodiment, the antenna comprises a cylindrical non-conductive antenna substrate with first and second opposing ends defining a central axis therethrough. The antenna also includes a plurality of rigid conductive circuit windings integral to the antenna substrate, each of the plurality of conductive circuit windings spaced-apart from each other. Each of the windings are electrically and physically separated from the others, and the circuit windings extend along at least a portion of the length of the antenna housing to define a signal path. Preferably, each of the conductive windings begin at a first radial position on the antenna housing relative to the central axis and translate to a second radial position different from the first radial position along the length of the signal path. Also preferably, each of the conductive windings translate about a surface of the antenna to define a helix pattern along the length of the signal path. An outside housing cover can enclose the substrate, as desired.

An additional embodiment of the present invention is a multi-layer cylindrical antenna. The multi-layer antenna comprises a first core insert layer and a second layer disposed over the first layer. The antenna also includes a third layer disposed over predetermined portions of the second layer opposite the first layer such that the third layer is non-conductive. A conductive fourth layer is disposed over the portions of the second layer remaining uncovered by the third layer. The fourth layer defines at least one signal trace and is arranged with the second and third layers such that each of the at least one signal trace is spaced-apart by the non-conductive third layer. Preferably, the antenna includes four traces arranged in a helical pattern along a major portion of the length of the antenna.

Another aspect of the present invention is a method of fabricating an antenna with integral traces formed thereon. The method includes molding a first antenna layer of a first material having an affinity for conductive coatings in a predetermined geometrical shape. A second antenna layer of a second material is formed over selected areas of the first layer. Surfaces of predetermined portions of the first antenna layer are maintained to be exposed. The exposed surfaces of the first layer is coated with a conductive coating thereby fabricating an integrated conductive signal path antenna. Preferably, the second layer is formed of a non-catalyzed material and the first layer is formed of a catalyzed material. Alternatively, the first layer is formed of a material receptive to metallic coatings and said second material is non-receptive to metallic coatings. In one embodiment, a selected surface of the antenna is exposed to photo-imaging to form a portion of the signal path.

Advantageously, molding the antenna traces integral to the antenna housing or substrate can improve the performance of the radiotelephone as well as reduce labor costs and decrease dimensional variability typically associated with conventional flex circuit fabrication methods.

The foregoing and other objects and aspects of the present invention are explained in detail in the specification set forth below.

BRIEF DESCRIPTION OF THE DRAWINGS

FIG. 6 is an enlarged partial cutaway view of yet another embodiment of an antenna according to the present invention.

FIG. 6A is a sectional view of the antenna of FIG. 6.

FIG. 8A is a partial section view of an antenna body undergoing photo-imaging to provide rigid traces on a substrate according to one embodiment of the present invention.

FIG. 8B is a partial section view of the antenna body shown in FIG. 8A after the photo-resist material has been exposed and developed.

FIG. 8C is a partial section view of the rigid traces formed on the antenna body shown in FIG. 8B after the photo-resist material and copper background has been removed.

DESCRIPTION OF PREFERRED EMBODIMENTS

The present invention will now be described more fully hereinafter with reference to the accompanying figures, in which preferred embodiments of the invention are shown. This invention may, however, be embodied in many different forms and should not be construed as limited to the embodiments set forth herein. Like numbers refer to like elements throughout. Layers may be exaggerated for clarity. As used herein, rigid is meant to include windings or traces which are sufficiently inflexible such that they are static, i.e., such that they are fixed along an expanse of the (antenna) body.

Figure 1:
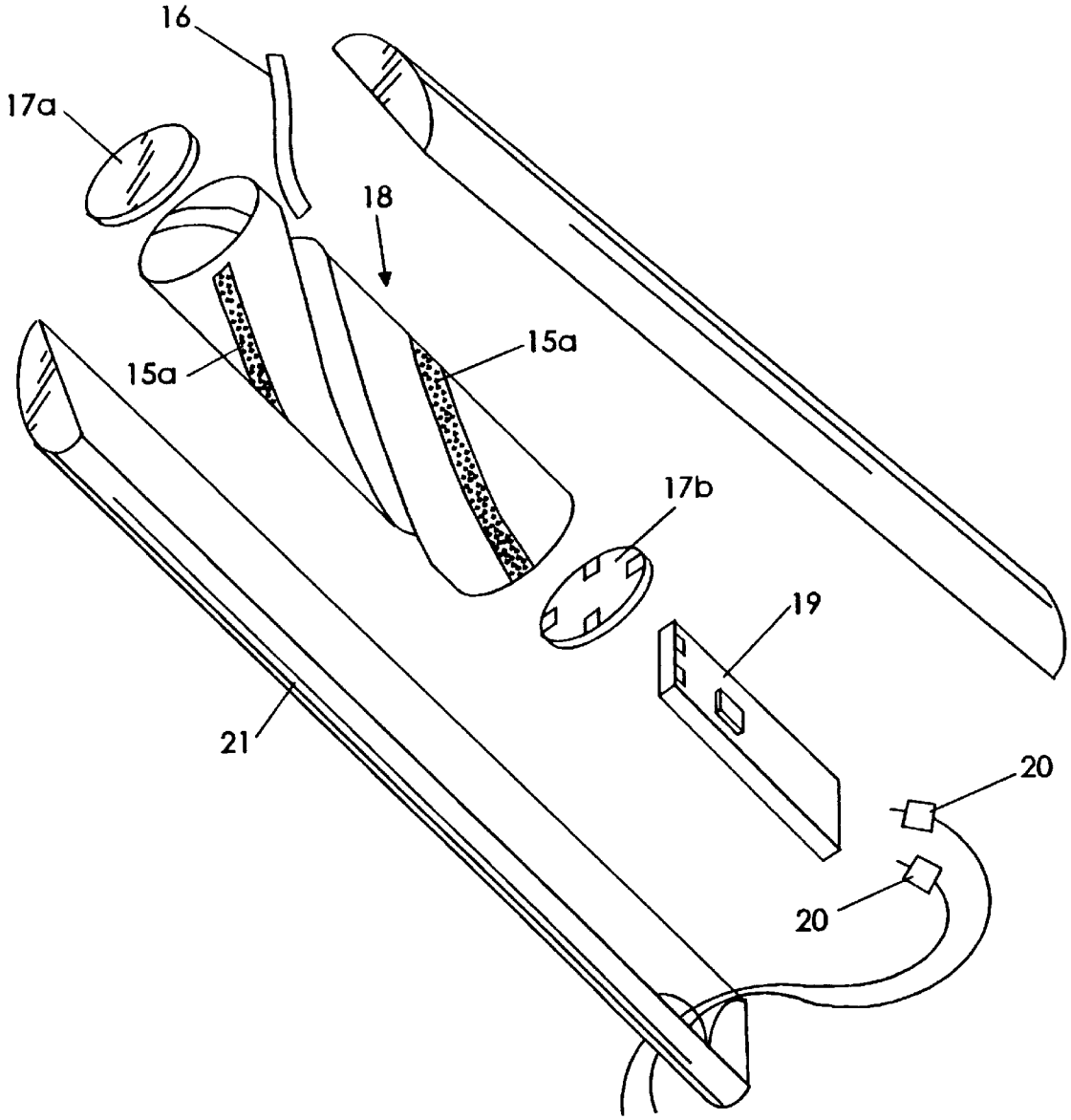
FIG. 1 PRIOR ART
FIG. 1 is an exploded view of a conventional wrapped antenna and associated separate printed circuit board.
Figure 2A:
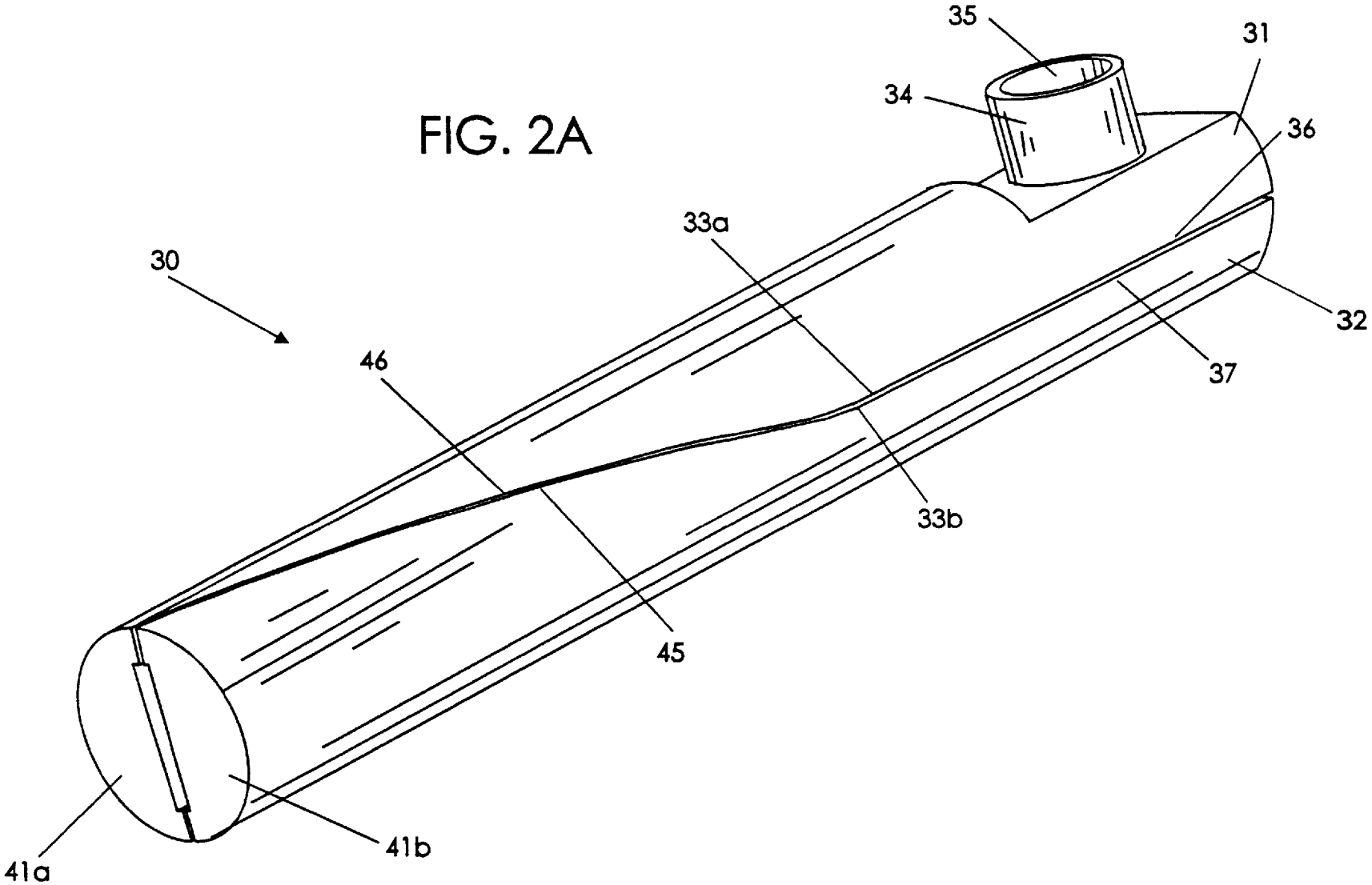
FIG. 2A is an enlarged perspective view of one embodiment of an antenna according to the present invention.
Figure 2B:
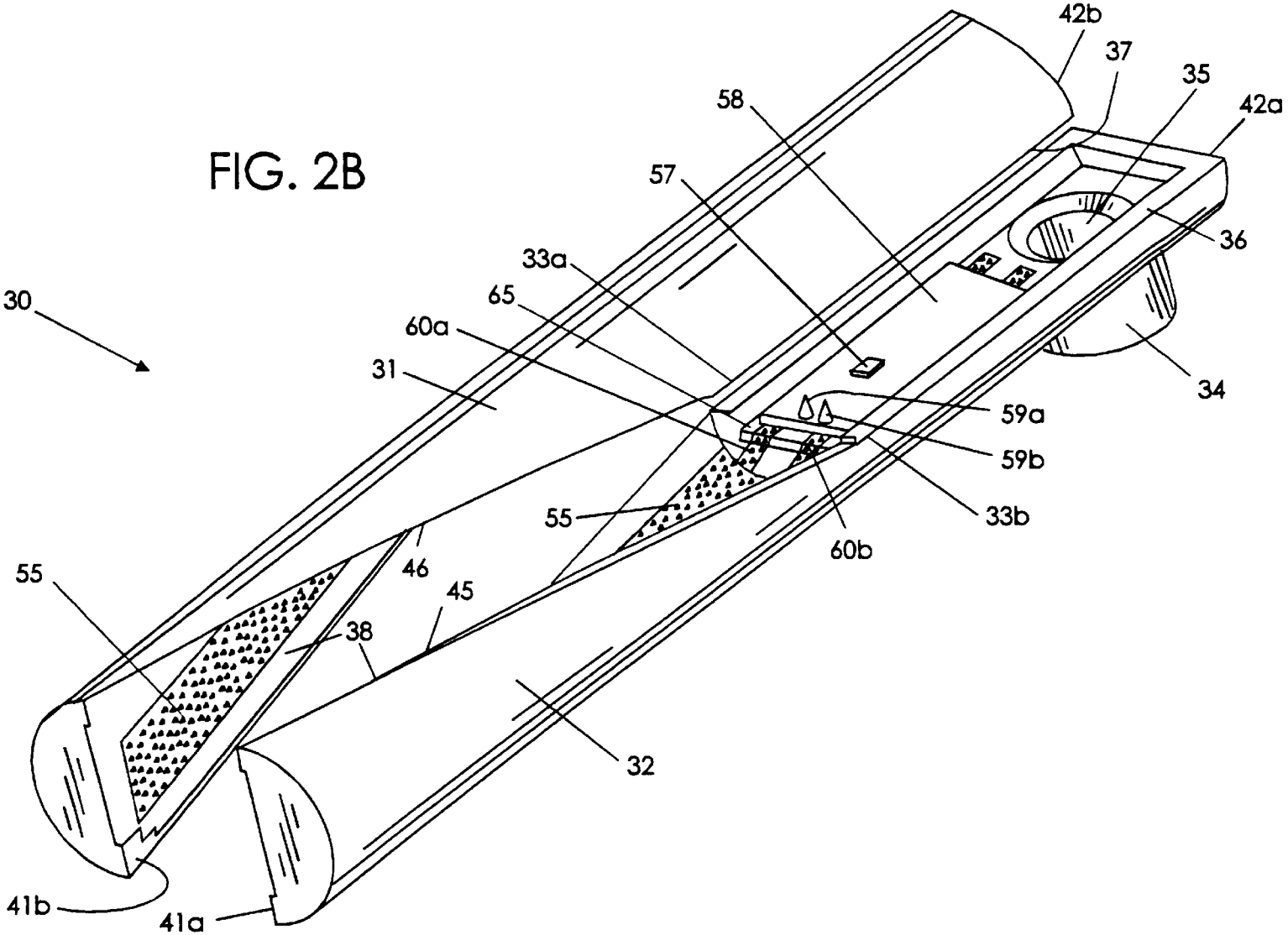
FIG. 2B is an enlarged exploded perspective view of the antenna of FIG. 2A, illustrating the assembly of the matable antenna members according to one embodiment of the present invention.

The present invention is directed towards antennas and is especially advantageous for antennas used in portable radiotelephone applications. Generally described, the present invention integrally forms the antenna element(s) directly into the antenna housing. This advantageously eliminates the wrapping or forming and assembly procedures of conventional flex circuit wrapped antennas as described above by providing rigid antenna elements integral to the housing or antenna substrate. Turning now to the figures, FIG. 2A illustrates an antenna 30 of one embodiment of the instant invention. As shown in FIG. 2A, the antenna 30 includes longitudinally extending first and second members 31, 32 which are matably sized and configured to assemble together. Preferably, as shown in FIG. 2B, when the members 31, 32 are assembled together, they define an enclosed passage therebetween. Also preferably, the members 31, 32 include opposing first and second ends 41*a*, 41*b* and 42*a*, 42*b*. Thus, when assembled, the members align to form closed ends thereby protecting the enclosed components from environmental conditions.

Further, in a preferred embodiment, as illustrated in FIGS. 2A and 2B, the first and second members 31, 32 include laterally extending portions 33*a*, 33*b* which mate with the other and form a cylinder when assembled together. Of course, alternative shapes or configurations can also be used such as oval, square, and the like. Preferably, a symmetrical shape is employed and most preferably a cylindrical shape. The laterally extending portions 33*a*, 33*b* can be further described as having opposing first planar portions 36, 37 and opposing second portions 45, 46 each of which are angled with respect to the corresponding first portions 36, 37. Advantageously, as will be discussed in more detail below, this configuration allows a mold or parting line to be positioned between conductive traces 55 and can help assure minimal electrical mismatch in the signal path. The two members 31, 32 can be assembled together in any number of ways as is well known to those of skill in the art. For example, the parts can be joined by press fit, ultrasonic weld, or bonded or joined with adhesive. If desired, crossovers at the top of the antenna 30 can be provided with additional traces, interlocking tabs, or an additional component installed into the interior of the members 31, 32 prior to assembly for electrically connecting traces crossing over the surface of the antenna (not shown).

Figure 3:
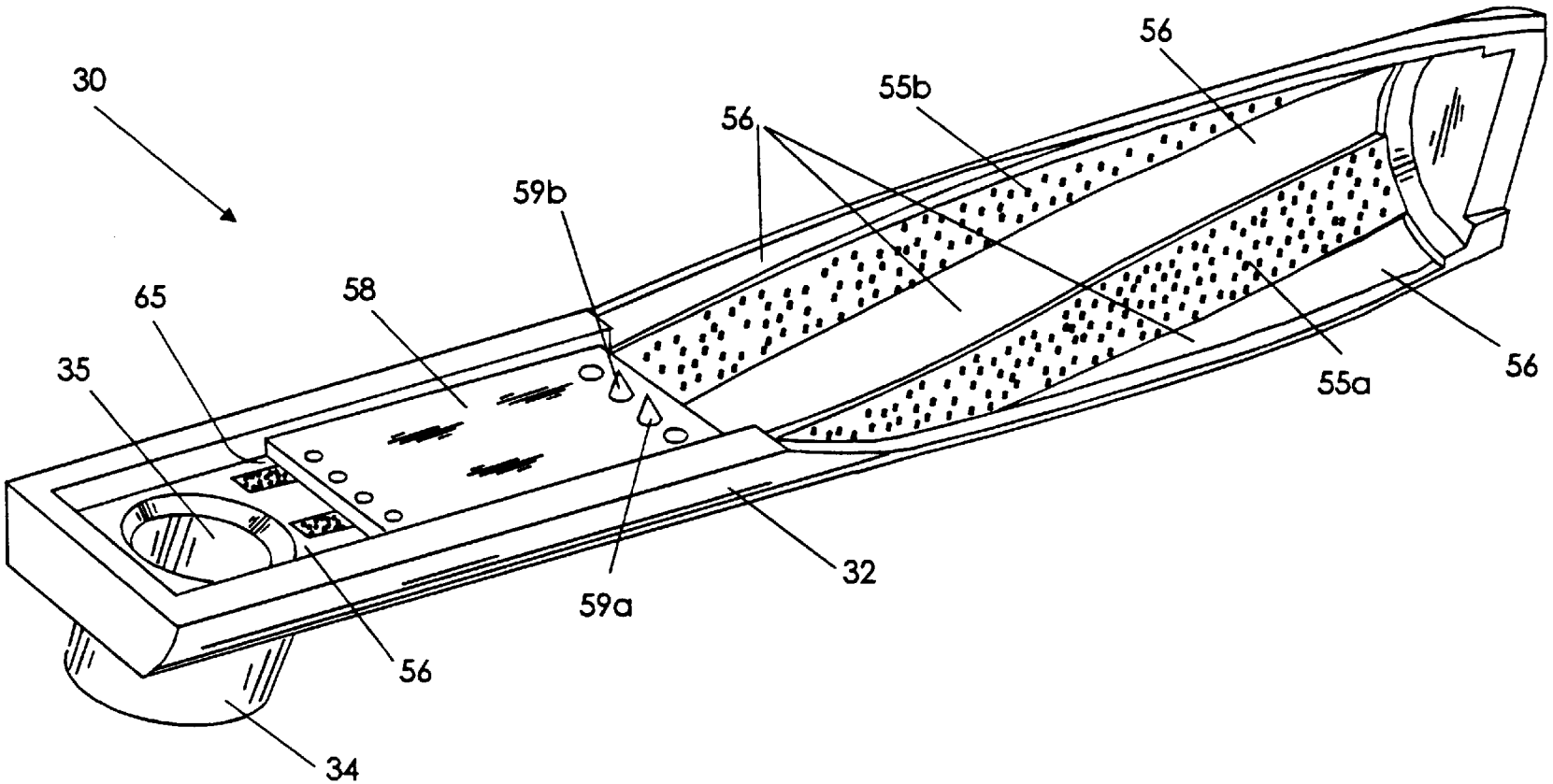
FIG. 3 is an enlarged partial perspective view of an antenna with integral circuit windings of the antenna of FIGS. 2A and 2B.

The antenna 30 can be mechanically attached to a radiotelephone (not shown) by a pivot or hinge 34. Of course, as is well known by those of skill in the art, any number of additional attachment means can be employed such as adhesive, bonding, screw, quick connects, and the like. Preferably, a pivotable attachment means is used so that the antenna 30 may be rotated to an extended position for use and then rotated back to a stowed position to rest against the radiotelephone body when not in use (not shown). As shown in FIGS. 2A, 2B, and 3, the pivot 34 includes an opening 35 through which electrical connections with the radiotelephone can be maintained. For example, as will be appreciated by those of skill in the art, electrical connections such as wires can be routed through the opening 35 and into the receiving member of the pivot. Alternatively, the external surface of the pivot can provide circuit connections (not shown).

As shown in FIG. 2A, the antenna 30 includes a non-conductive (cylindrical) housing 56 and at least one integral and structurally rigid conductive circuit trace or antenna element 55. The housing can comprise one, two, or more members, but in this embodiment preferably includes two members as discussed above. FIGS. 2B and 3 illustrate the internal portion of a preferred embodiment of one of the members 32 which forms half of the antenna. As shown in FIG. 3, the first member 32 includes two traces 55*a,* 55*b* integral to the housing, i.e., formed directly on the inner radius of the housing member. Similarly, the opposing member 31 also includes two traces 55*c,* 55*d* (not shown) to provide a quadrafillar antenna. Also as shown, the windings 55*a,* 55*b* are spaced-apart and separated by or interposed with non-conductive housing material 56. Upon assembly, the windings or traces 55 are electrically connected to geometrically align and complete a signal path. Thus, each of the first member and second member 31, 32 includes a predetermined trace 55 pattern which, upon assembly together, electrically engage to define a signal path.

As shown in FIGS. 2B and 3, the antenna 30 also includes an auxiliary printed circuit board 58 mounted to a rigid support portion 65 of the housing. In particular, the auxiliary circuit board 58 is preferably positioned in the planar portion 36 of the antenna housing member 32 intermediate of the pivot 34 and the angular portion of the member 32 to facilitate connection with the signal processor in the radiotelephone (not shown) to allow electrical transmission of the signal or RF feed from and to the antenna. Of course, as will be understood by one of skill in the art, alternative circuit board connections and configurations can also be used to interconnect the traces or windings 55*a,* 55*b* to the desired circuitry associated with the telephone or device.

As shown in FIG. 3, the printed circuit board 58 includes various circuitry 57 and electrical contacts for connection with the individual traces 55. As shown, two of the electrical contacts 59*a,* 59*b* are protruding contacts which laterally extend towards the opposing member 31 for interconnection of antenna elements 55*c,* 55*d* contained on the opposing mating portion of the antenna housing 31. Also as shown, traces 55*a,* 55*b* on the member 32 are electrically connected to the auxiliary printed circuit board 58 via conductive strips 60*a,* 60*b* formed in the housing from each of the windings to the board. Thus, all four traces are connected to the printed circuit board 58. Alternative configurations or electrical interconnections of the rigid traces of the antenna to the respective printed circuit board contact include, but are not limited to, soldering, press-fit pins, elastomeric connectors and the like.

Figure 4:
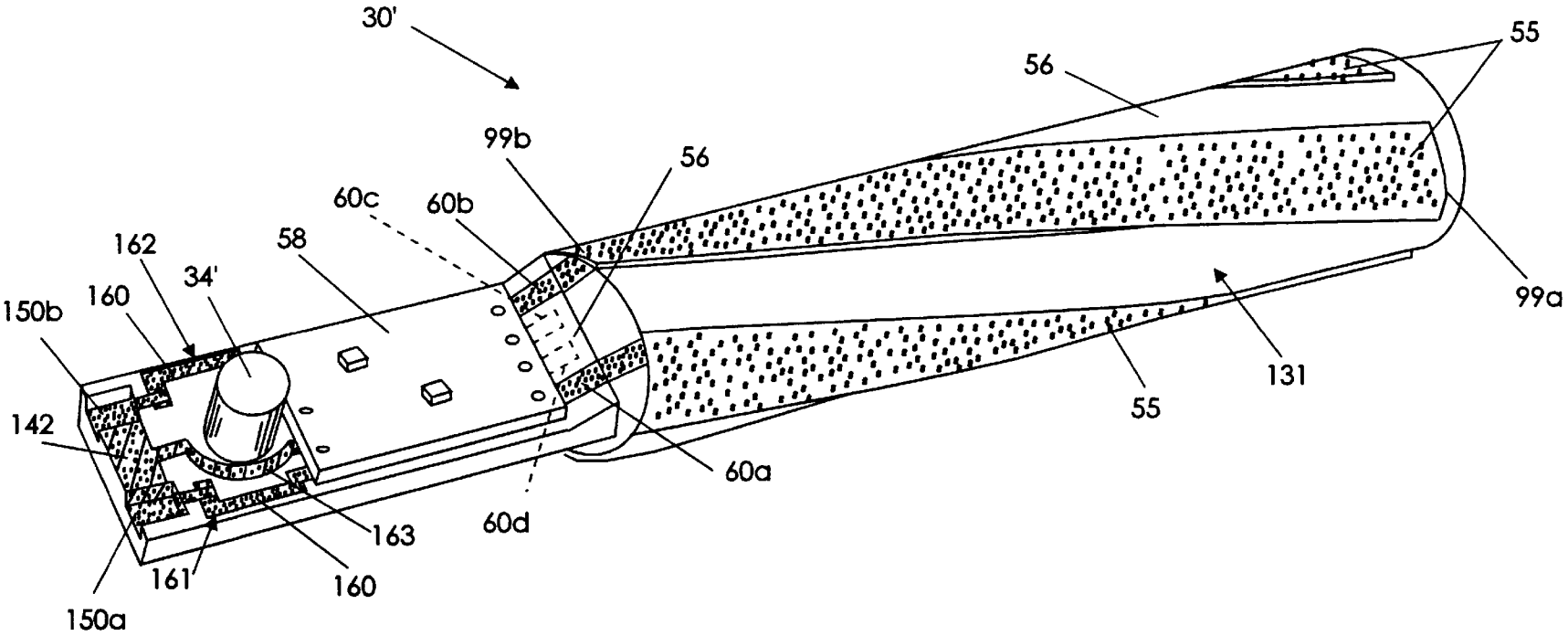
FIG. 4 is an enlarged perspective view of an alternative embodiment of an antenna according to the present invention.

FIG. 4 illustrates an additional embodiment of an antenna 30' according to the instant invention. Unlike the embodiment discussed above, this embodiment includes a unitary substrate 131 and the rigid antenna elements or traces 55 are formed on the circumference of the antenna 30'. The traces can be either recessed or substantially flush with the adjacent non-conductive housing material, or raised to laterally extend beyond the non-conductive surfaces 56. As shown, the antenna 30' includes a pivot 34' and integrally formed cable retention or cable routing channels 150*a,* 150*b*. Preferably, as shown, the antenna 30' also includes integrally formed and outwardly accessible electrical traces 160 disposed between the auxiliary circuit board 58 and the end 142 of the antenna to electrically connect the signal path(s) from the antenna with the telephone. Generally stated, radiotelephones include two signal paths, one for satellite and one for cellular communication. As such, as shown in FIG. 4, the traces 160 include a first signal trace 161, a ground trace 163, and a second signal trace 162. Correspondingly, the traces are preferably sized and configured with cable routing channels 150*a,* 150*b* to receive respective signal coaxial cables therein.

Figure 5A:
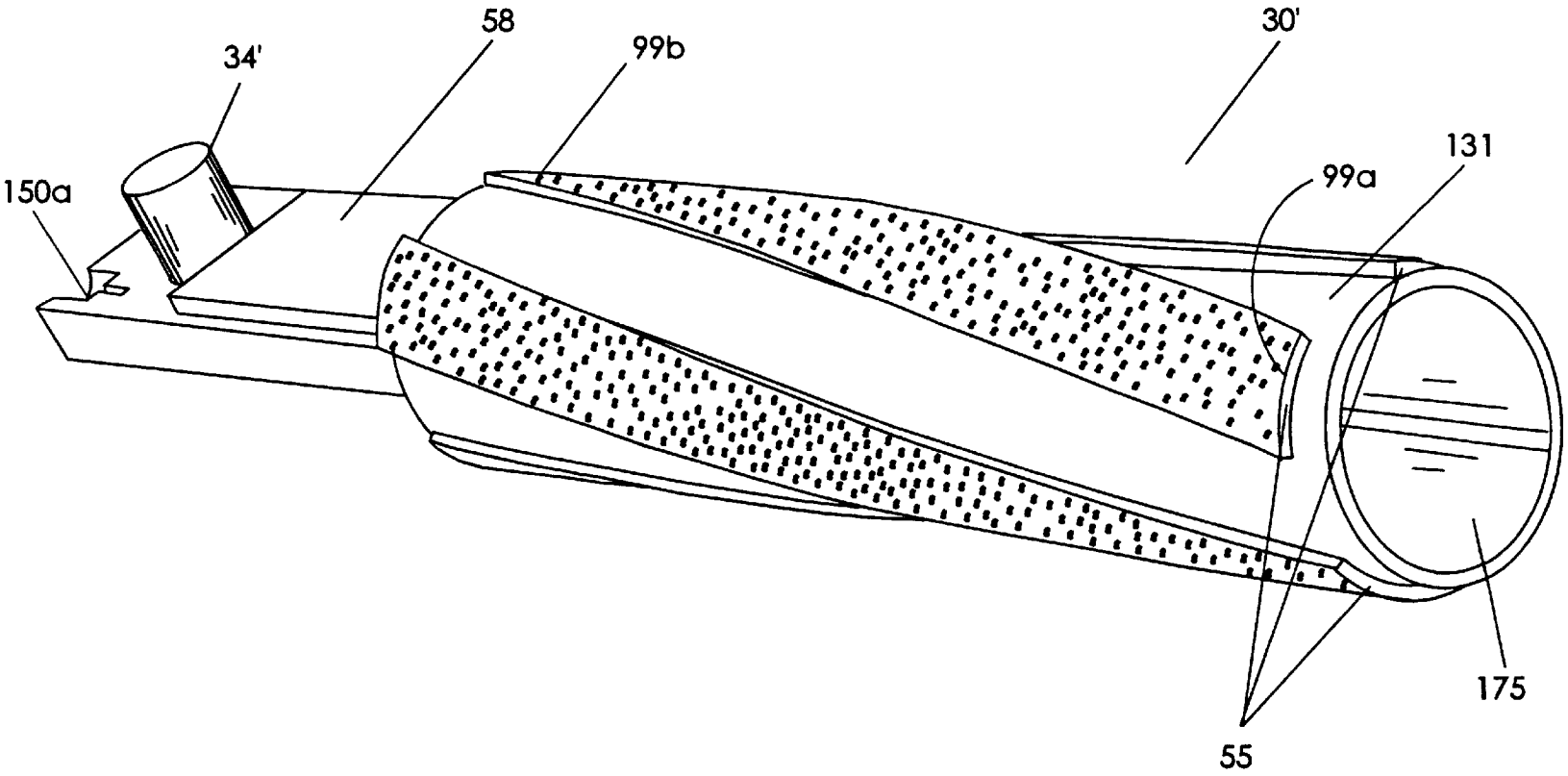
FIG. 5A is an enlarged perspective view of an additional embodiment of an antenna according to the present invention.
Figure 5B:
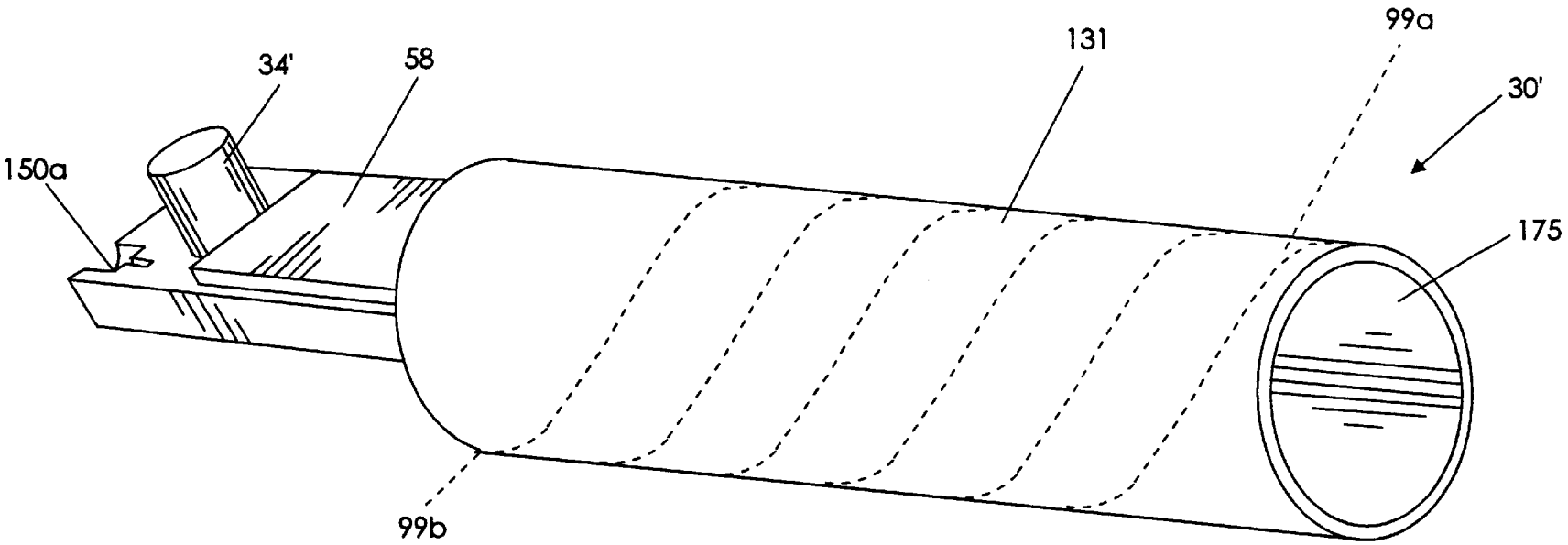
FIG. 5B is a side view of an antenna according to the present invention illustrating an alternative winding configuration.
Figure 5C:
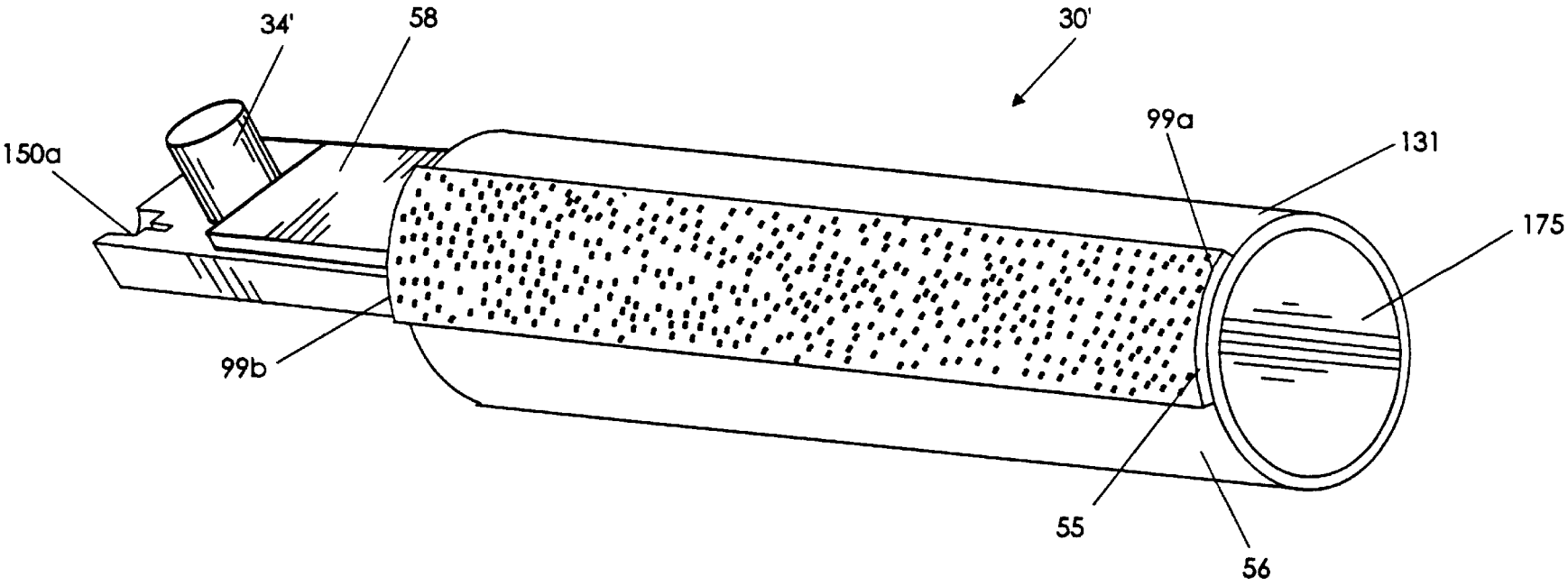
FIG. 5C is a side view of an antenna according to the present invention illustrating yet another alternative winding configuration.

The antenna substrate 131 can be a solid but preferably lightweight body (such as a cylinder or other configuration). Alternatively, as illustrated in FIG. 5A, the antenna 30' can be configured with a hollow core 175. Each of these alternatives will preferably provide a light weight antenna body to facilitate easy transportability and use. FIGS. 5B and 5C illustrate additional trace 55 patterns as will be discussed further below.

FIGS. 6 and 6A illustrate an additional embodiment of an antenna 30' with a hollow core 175. This configuration includes a hollow insert 275, shown as a cylindrical insert 275. The insert 275 is positioned internal to the substrate member 131 to keep the core open during fabrication of the substrate and becomes part of the antenna structure as will be discussed further below. Preferably, the insert 275 is a closed end hollow cylindrical insert, allowing the end cap to be integral to the antenna housing body 131. Advantageously, this configuration allows a trace 55 to be integrally positioned in the end cap 141 concurrently with the traces 55 in the antenna body 131. In a preferred embodiment, the housing 131, the closed end cap 141, and the windings or traces 55 thus provide a unitary integral body. A crossover 151 with an electrical trace 151*a* can also be positioned in the end cap 141 to provide an electrical path over the trace 55 crossing thereunder. Alternatively, a low density core insert can be employed such that it fills the core volume but is light weight and yet able to maintain the structural integrity of the substrate during fabrication of same (not shown). Yet an additional alternative is to form the fabrication tooling to be removable after the housing is formed so that the core is hollow, as will also be discussed further below.

As illustrated by the sectional view of FIG. 6A, one preferred embodiment of a hollow core antenna 30 includes four layers. The first layer 180 is the insert 275 which includes a hollow core 175. The second layer 280 overlays and is molded to the first layer 180 and is preferably a platable polymer. The third layer 380 overlays and is preferably molded and the like to predetermined portions of the second layer 280. The third layer 380 is non-conductive and is the portion of the antenna structure 56 which forms the housing 131 and separates the conductive traces 55. The fourth layer 480 overlays portions of the second layer 280 not covered by the third layer 380 and is plated or similarly treated to be conductive to provide the conductive traces 55. Preferably, as shown in FIG. 6A, the traces 55 (defined by the fourth layer 480) extend radially outward a distance greater than the adjacent third layer 380. Also preferably, the second layer 280 extends through the perimeter of the third layer 380 in four separate radial positions to provide a quadrafillar trace pattern. Although not shown, a fifth layer of a thin coating, film or the like, can also be positioned over any externally exposed traces to protect them from environmental conditions.

Referring now to the winding or trace pattern, it is preferred that multiple traces 55 be geometrically aligned and configured along a portion of the antenna 30 such that they form a signal path on the antenna. The traces 55 more preferably extend along a major portion of the length of the antenna (greater than half the length). The longitudinally extending antenna 30 can be described as defining a central axis through the center thereof As such as shown in FIG. 5A, in a preferred embodiment, each of the conductive windings or traces 55 begin at a first position 99*a* on the antenna housing relative to the central axis and translate to a second radial position 99*b* different from the first radial position along the length of the signal path. The radial translation can be any number of radians to provide a desired signal path, such as 15 degrees, 30–90 degrees, or more. For larger radial translations, a serpentine pattern may be advantageous to employ so as to efficiently fit multiple windings on the circumference of the antenna. Of course numerous other geometric configurations are also suitable, and the instant invention is not limited to the helical or sinusoidal pattern exemplary described herein. It is further preferred that four spaced-apart traces 55 be configured along a portion of the antenna 30. As illustrated in FIGS. 5A and 6A, it is most preferred that the traces 55 be arranged in a quadrafillar helix pattern.

Preferably, the electrical length of the antenna 30, 30' (typically defined by the length and configuration of the traces) is predetermined. Further preferably, the electrical length of the antenna 30, 30' is configured to provide a quarter or half wavelength so that the antenna 30, 10' resonates with the operation frequency (typically about 1500–1600 MHz).

Figure 7A:
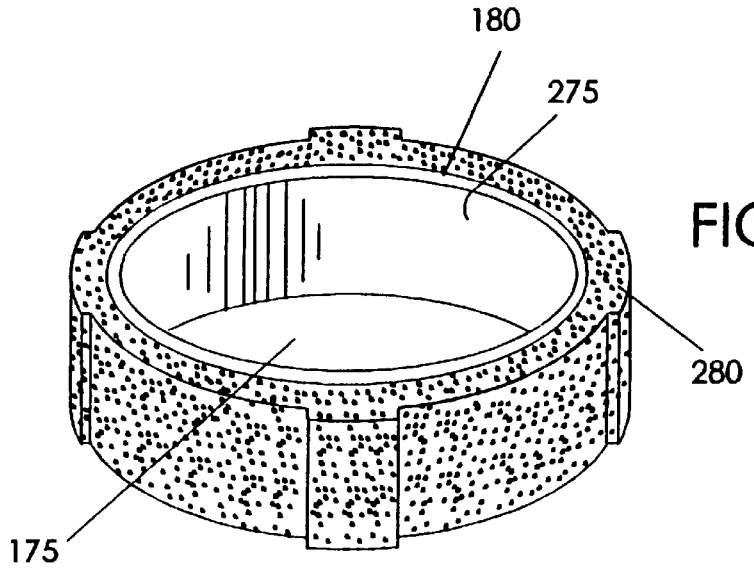
FIG. 7A is a perspective view of a first stage molding process illustrating predetermined raised surfaces on an antenna sub-component according to one aspect of the present invention, the raised surfaces will be conductive in a finished part as shown in FIG. 7C.
Figure 7B:
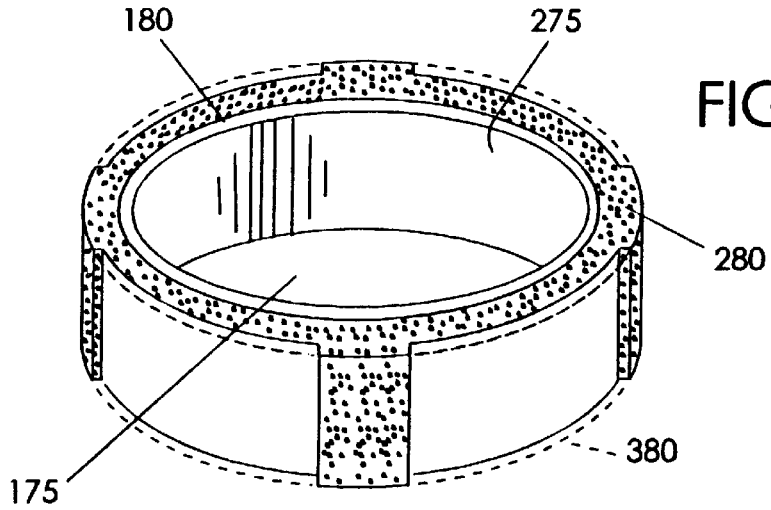
FIG. 7B is a perspective view of a second stage of a molding process illustrating the molded part of FIG. 7A with additional material molded over predetermined areas of the first sub-component.
Figure 7C:
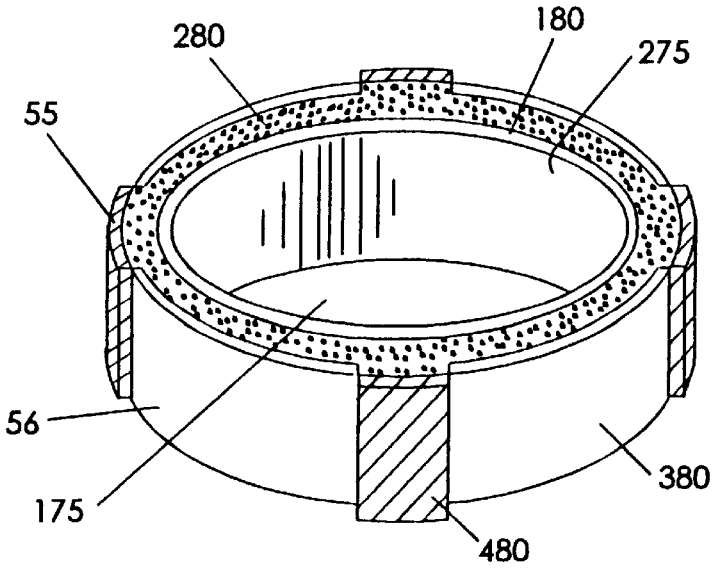
FIG. 7C is a sectional view of the part illustrated in FIG. 7B after the part has been metallically plated according to one embodiment of the present invention.

Turning now to FIGS. 7A, 7B, and 7C, a preferred method of fabricating an antenna is illustrated. In this embodiment, a two-shot molding process is used to form the configuration of the antenna 30. Two different materials or material compositions are preferably used, one with an affinity for conductive coatings 480 (which will form the base of the conductive traces 55) and one without such affinity 580 (which will form the non conductive housing 56 intermediate the traces 55). The first material 480 is used in the first shot and the second material 580 in the second shot. Examples of first and second materials which can be used include materials with and without catalysts, or materials which are platable and a non-platable material; for example, liquid crystal polymer, ULTEM, and aromatic nylon.

Preferably, in the first shot (FIG. 7A), a catalyzed polymer material is molded in a manner which exposes predetermined portions or surfaces desired to be conductive in the end component for plating or other metallic or conductive coatings after the second mold shot is disposed onto the first mold shot. For example, as illustrated in FIG. 7A, the first shot forms the layer 280 over the core and provides material which will interrupt the third layer 380 so that it is non-contiguous along the trace length along with respect to a surface of the antenna. In the second shot (FIG. 7B), the second material such as an uncatalyzed polymer is molded over predetermined portions or surfaces of the first material to insulate areas in which conduction is not desired, and in a manner which leaves the catalyzed polymer of the first material exposed on surfaces where plating is desired. Referring again to FIG. 7A, the second material such as a non-platable polymer forms layer 380 and non-conductive housing areas 56. After molding, the exposed surfaces of the first material can be plated or coated or otherwise treated (FIG. 7C), to create the conductive and non-conductive pattern desired to define the separate signal and ground paths thereon. As shown in FIG. 7C, the fourth layer 480 is formed by metallizing the platable polymer or first material thus providing the integral traces 55. Many ways exist to implement the conductive coating, such as dipping, plating, or painting the desired surface treatment thereon. Preferably, plating is used to obtain the conductive surface. In a preferred embodiment, an electroless plating deposit is placed on the exposed catalyzed features. Typical electroless and electroplated materials include copper nickel, tin, and gold.

Alternatively, one may employ a photo-imaging and photoresist technique by using multiple exposures to form the desired electrical pattern or structure. Of course, combinations of photo-imaging and the two-shot molding process can also be used. For example, circuits that wrap around edges may be formed using the two-shot process, while the crossover pattern on the end cap 141 can be added using photo-imaging.

FIGS. 8A, 8B, and 8C illustrate one embodiment of an antenna body 30*a* having rigid traces 555 formed by a photo-resist process. FIG. 8A illustrates a first substrate layer 500. This layer is non-conductive such as a polymer or plastic. This is the base layer and is preferably longitudinally extending similar to those antenna bodies shown in FIGS. 4 and 5. Preferably, the substrate is cylindrically shaped. A thin layer 510 of conductive material is placed on the substrate 500. This will prepare the base substrate layer 500 for adhesion with other materials in subsequent processing. An example of a suitable material layer for this material layer 510 is a copper flash layer typically disposed via thin electroless copper plating. A photo-resist material 520 is then disposed on the thin conductive layer 510. Preferably, the photo-resist is negative acting. A formed mask 540 is positioned over the photo-resist layer 520. The formed mask includes opaque 531 and transparent portions 530 and is configured to overlay the cylindrical substrate such that the traces will be defined by the imaging pattern thereon. Various projection methods of exposure can also be used in lieu of a contact mask. Because a negative acting photo-resist is described, the opaque portions 531 correspond to areas which are desired to form the rigid signal traces 555 on the substrate 500. A light source 600 is applied to expose or image the desired areas on the substrate 500 through the mask 540 (typically at about 265 nano-meter wavelengths).

After imaging or exposure, the photo-resist material is developed. As shown in FIG. 8B, the areas blocked by the opaque portion 531 of the mask 540 are further exposed to electroplate conductive materials (Cu, Au, etc.) to add desired conductor thicknesses to the underlying copper layer 510 to provide a second layer 550 of conductive material thereon. As shown in FIG. 8C, the antenna body 30*a* is then completed by stripping the photo-resist 520 and etching away the background copper material 510 which is positioned between the signal traces 555. Thus, a multi-layer antenna body 30*a* with at least one rigid signal trace is provided. As shown, the antenna body includes a substrate layer 500, a second layer of conductive material 510, and a third layer of conductive material 550. The second and third layers define the signal traces 555 thereon. Preferably, the signal traces are shaped similar to those discussed above in alternative embodiments. As will be appreciated by one of skill in the art, the antenna body 30*a* can also include vias formed through the substrate 500. The negative resist process allows the via to be processed to provide a conductive signal path through the substrate layer 500 and can interconnect or provide signal paths between the layers.

In summary, the instant invention allows the antenna configuration to have integral windings 55 thereon as well as other mounting and interconnection features (electrical and mechanical). For example, molded tabs, press-fit pins, electrical contacts and traces from the helix or windings 55 to the printed circuit board. In addition, if a three-layer or higher circuit board is not necessary, all the circuitry may be placed on the molding itself without the need for a separate auxiliary printed circuit board. Three-layer or greater circuits are not preferred to be formed in the molding process described above because of the costs typically associated therewith.

Figure 5D:
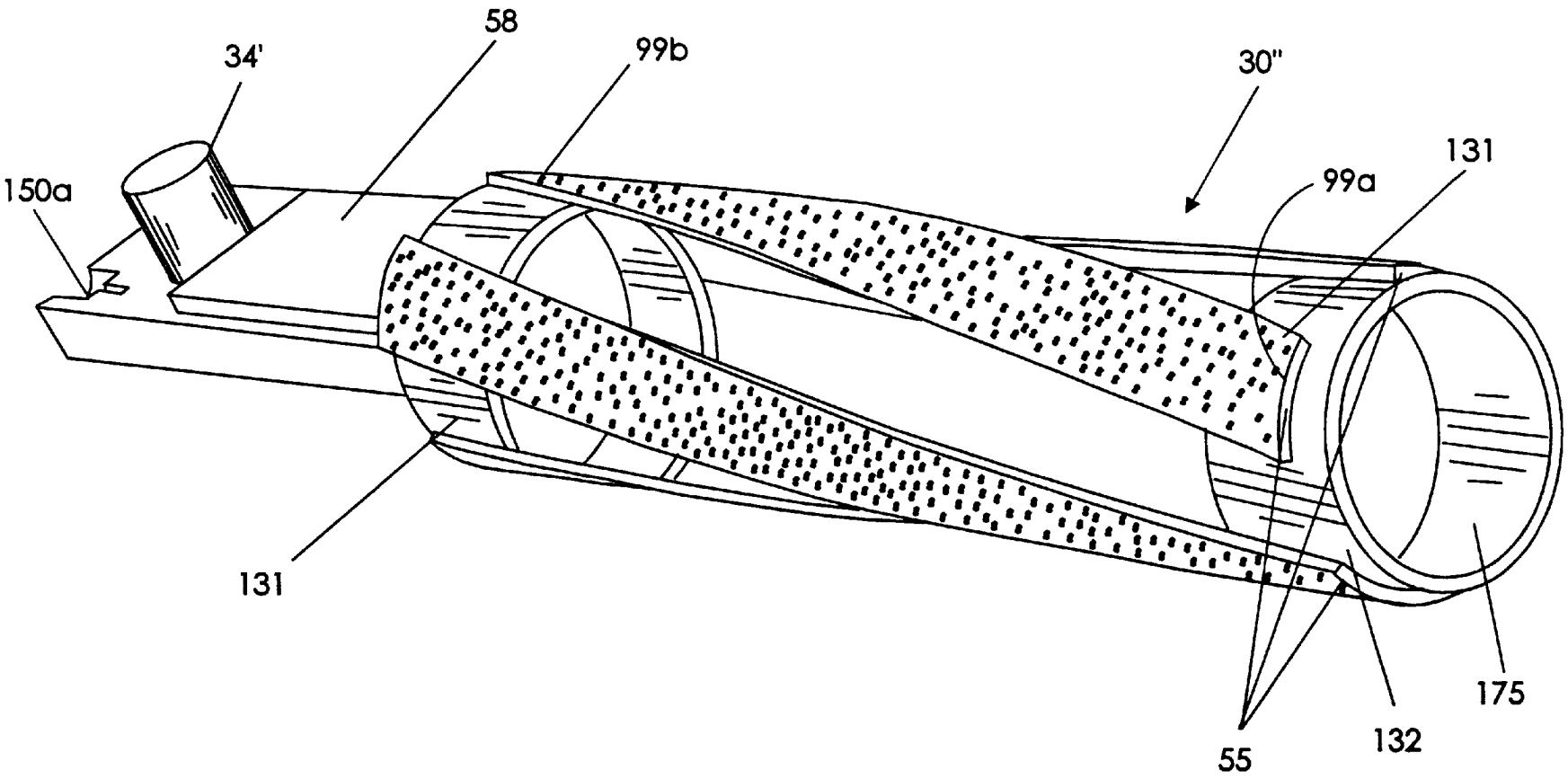
FIG. 5D is an enlarged perspective view of another embodiment of an antenna according to the present invention.

Although the description has described the antenna with a rigid support portion 65 and integrated pivot 34 formed in the longitudinal body or member, it will be appreciated by those of skill in the art that multiple components can be used to provide same. Similarly, although described throughout as a cylindrical antenna, the antenna can be alternatively shaped. Further, although shown as a contiguous substrate with the windings separated by non-conductive material (such as in FIG. 4), the rigid antenna windings 55 can be formed or configured such that they are separated by free-space. FIG. 5D illustrates one possible embodiment of a bird cage antenna winding structure 30" which can provide a desired rigid winding configuration. For example, a plurality of windings 55 structurally connected at the top and bottom portions 132, 133 but spaced-apart therebetween by free-space or air. This embodiment can reduce the amount of material used (lighter weight) and can even allow both sides of the traces to be conductive.

As described above, it is preferred that the antenna be configured as a hollow core structure. It is preferred that when molding the antenna, tooling is used which will form the molded material into a hollow structure and then which will be removed when the material is cured. When molding a two member antenna as illustrated in FIGS. 2 and 3, the tooling can be easily removed because of the central parting line. However, when molding a one-piece body (FIGS. 4, 5, and 6) the tooling is removed from one end of the molded body. In such a situation, it is preferred that the antenna be configured slightly larger at one end to allow easier removal of the tooling. Alternatively, as discussed above, a stationary core insert 275 can be employed. Advantageously, this type of insert will provide a hollow core without requiring removal of the insert. The stationary core insert can be a hollow core insert such as a blow molded hollow tube or flow molded thin material, or a low density or foam type insert. The latter type of insert can be subsequently processed such as by acid etch to remove the material from the core.

As will be appreciated by those of skill in the art, the above described aspects of the present invention may be provided by hardware, software, or a combination of the above. For example, one or more components of the circuit 57, can be a implemented as a programmable controller device or as a separate discrete component. Of course, discrete circuit components and discrete matching or other electrical circuits corresponding to the impedance requirements of the antenna can be employed with the integrated antenna and can be mounted separately or integrated into a printed circuit board. Similarly, the term "printed circuit board" is meant to include any microelectronics packaging substrate.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clause are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A radiotelephone antenna, comprising:

a longitudinally extending first member having at least one rigid conductive winding arranged in a first pattern thereon; and a longitudinally extending second member having at least one rigid conductive winding arranged in a second pattern thereon, said second member configured to matably engage with said first member to define an enclosed passage therebetween, wherein when said first and second members are engaged, said first and second pattern of conductive windings are electrically connected and geometrically aligned in a pattern to define a signal path.

2. An antenna according to claim 1, wherein said first and second patterns radially translate along the length of the antenna in a helical pattern.

3. An antenna according to claim 2, wherein said first member and said second member comprise laterally extending portions which mate with the other when assembled theretogether.

4. An antenna according to claim 3, wherein said laterally extending portions include a first planar portion and a second portion angled with respect to said first portion, and wherein each of said at least one windings are disposed on said angled portion.

5. A radiotelephone antenna according to claim 1, wherein said rigid conductive windings are formed as a surface pattern on an internal surface of said enclosed passage.

6. A radiotelephone antenna according to claim 1, wherein said rigid conductive windings are integrally formed onto predetermined portions of said first and second members.

7. An antenna, comprising:

a substantially rigid non-conductive antenna substrate having first and second opposing ends having a length and defining a central axis therethrough; and a plurality of rigid conductive circuit windings formed integral to said antenna substrate, each of said plurality of conductive circuit windings are spaced apart from each other, wherein each of said conductive circuit windings are electrically and physically separated from the others, and wherein said conductive circuit windings extend along at least a portion of the length of said antenna substrate to define a signal path, and wherein said conductive circuit windings are integrally formed onto said substrate by one or more of a two-shot molding process, photo-imaging, or photo-resist processing method.

8. An antenna according to claim 7, wherein each of said conductive windings begin at a first radial position on said antenna substrate relative to the central axis and translate to a second radial position different from said first radial position along the length of the signal path.

9. An antenna according to claim 8, wherein each of said conductive windings translate about a surface of said antenna to define a helix pattern along the length of the signal path.

10. An antenna according to claim 8, wherein said antenna includes matably configured first and second members, and wherein said first member includes a first conductive winding pattern which radially translates along the length of the signal path and said second member includes a second conductive winding pattern which radially translates along the length of the signal path such that when said first and second members are engaged, said first and second winding patterns are electrically engaged to define the signal path.

11. An antenna according to claim 8, said antenna substrate having a longitudinally extending inner wall, said antenna further comprising a substantially hollow core member positioned to firmly abut said inner wall of said antenna substrate.

12. An antenna according to claim 11, wherein said conductive windings are positioned on the outer surface of said substrate.

13. An antenna according to claim 12, wherein said antenna substrate, said conductive windings, and said core member are co-joined by molding together.

14. An antenna according to claim 12, wherein said antenna substrate further includes a closed end having at least one conductive winding thereon.

15. An antenna according to claim 14, wherein said antenna substrate, said conductive windings, and said antenna closed end define a unitary integral body.

16. An antenna according to claim 7, said antenna further comprising a rigid support portion for holding electronic components thereon, said support portion disposed in one end of said antenna and configured to be electrically connected with each of said windings.

17. An antenna according to claim 16, wherein said support portion includes a pivot joint thereon.

18. An antenna according to claim 17 in combination with a radiotelephone, wherein said antenna is affixed to said radiotelephone via said pivot joint.

19. An antenna according to claim 18, said support portion further comprising cable retention guides for locating electronic cables routed from said antenna to said radiotelephone.

20. An antenna according to claim 7, wherein said windings are circumferentially positioned along a major portion of the length of said antenna substrate.

21. An antenna according to claim 7, wherein said windings are internally positioned on the inner diameter along a major portion of said antenna substrate.

22. A multi-layer cylindrical antenna comprising:

a first core insert layer;

a second layer disposed over said first layer;

a third layer disposed over predetermined portions of said second layer opposite said first layer, wherein said third layer is non-conductive; and a conductive fourth layer disposed over the portions of said second layer not covered by said third layer, wherein said fourth layer defines at least one signal trace, and wherein said fourth layer is arranged with said second and third layers such that each of said at least one signal traces is spaced-apart by said non-conductive third layer.

23. A multi-layer cylindrical antenna according to claim 22, wherein said second layer comprises a catalyzed polymer material, and wherein said third layer comprises a non-catalyzed material.

24. A multi-layer cylindrical antenna according to claim 22, wherein said second layer is produced by a first molding shot and said third layer is produced on said second layer in a second molding shot after said first molding shot.

25. A method of fabricating an antenna with integral traces formed thereon, comprising the steps of:

molding a first antenna layer of a first material having an affinity for conductive coatings in a predetermined geometrical shape;

forming a second antenna layer of a second material over selected areas of said first layer;

maintaining exposed surfaces of predetermined portions of said first antenna layer; and coating exposed surfaces of said first layer with a conductive coating thereby fabricating an integrated conductive signal path antenna.

26. A method according to claim 25, wherein said second layer is formed of a non-catalyzed material and said first layer is formed of a catalyzed material.

27. A method according to claim 25, wherein said first layer is formed of a material receptive to metallic coatings and said second material is non-receptive to metallic coatings.

28. A method according to claim 25, further comprising the step of:

assembling discrete circuit components on said antenna to electrically communicate with said signal path when an antenna is connected to a radiotelephone.

29. A method according to claim 25, further comprising the step of:

exposing a selected surface to photo-imaging to form a portion of said signal path.

30. An antenna according to claim 25, further comprising a substantially hollow core member internally positioned in said antenna housing to firmly abut the inner diameter of said antenna substrate.

31. A method according to claim 25, wherein said antenna is molded in separate matable components as a first and second member.

32. A method according to claim 31, wherein a removable core shape is employed to form a hollow antenna passage, and wherein said core shape is removed prior to assembly of the first and second members.

33. An antenna body having rigid traces thereon, said antenna body comprising:

a longitudinally extending substrate having a plurality of rigid conductive windings thereon, wherein each of said plurality of conductive windings are spaced-apart, and wherein said rigid conductive windings are a surface pattern formed by one or more of a two-shot molding process and photo-imaging and photo-resist processing selected portions of at least one surface of said substrate.

34. An antenna body according to claim 33, wherein said conductive windings are spaced apart by openings in said substrate.

35. An antenna body according to claim 34, said substrate includes top and bottom portions configured to structurally join said plurality of conductive windings.

36. An antenna body according to claim 33, wherein each of said plurality of rigid conductive windings are spaced-apart by non-conductive material defined by said substrate.

37. An antenna body according to claim 33, wherein said rigid conductive windings are formed as a surface pattern onto said longitudinally extending substrate.

38. An antenna body according to claim 37, wherein said rigid conductive windings are integral to said longitudinally extending substrate and wherein said conductive windings are formed on an outer surface of said longitudinally extending substrate.

39. An antenna body according to claim 37, wherein said rigid conductive windings are integral to said longitudinally extending substrate and wherein said conductive windings are formed on an inner surface of said longitudinally extending substrate.

40. An antenna body according to claim 37, wherein said rigid conductive windings define a bird cage antenna configuration.

41. An antenna body according to claim 37, wherein said surface pattern is formed by a two-shot molding process, and wherein the first shot of said two-shot molding process comprises catalyzed material and the second shot of said two-shot molding process comprises non-catalyzed material.

42. A multi-layer antenna body, comprising:

a longitudinally extending first substrate layer;

a second conductive layer disposed over predetermined portions of said first layer;

a third conductive layer disposed over said second layer, wherein said second and third layers define at least one rigid signal trace integral to said first layer providing a signal path thereon.

43. An antenna body according to claim 42, wherein said longitudinally extending first substrate layer is cylindrically shaped and extends about a central axis and said second and third layers define a plurality of signal traces, and wherein each of said signal traces begin at a first radial position on said first substrate layer relative to the central axis and translate to a second radial position different from said first radial position along the length of the signal path.

44. An antenna body according to claim 42, wherein each of said signal traces translate about a surface of said antenna body to define a helix pattern along the length of the signal path.

45. An antenna body according to claim 42, wherein said signal traces are positioned on the outer surface of said first substrate layer.

46. An antenna body according to claim 42, wherein said signal traces are formed integral to said first substrate layer by photo-resist imaging.

47. An antenna body according to claim 42, wherein said at least one trace is circumferentially positioned along a major portion of the length of said first substrate layer.

48. A multi-layer antenna body according to claim 42, wherein said antenna body is shaped to define a bird cage configuration.

* * * * *